US006752660B2

(12) United States Patent
Fujita et al.

(10) Patent No.: US 6,752,660 B2
(45) Date of Patent: Jun. 22, 2004

(54) TERMINAL FITTING, CONNECTOR PROVIDED THEREWITH AND METHOD FOR PRODUCING THE TERMINAL FITTING

(75) Inventors: Shinya Fujita, Yokkaichi (JP); Yukihiro Fukatsu, Yokkaichi (JP); Takeshi Tsuji, Yokkaichi (JP); Ryotaro Ishikawa, Yokkaichi (JP); Hideto Nakamura, Yokkaichi (JP); Hajime Kawase, Yokkaichi (JP); Yuuichi Nankou, Yokkaichi (JP); Naoya Kurimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/238,132

(22) Filed: Sep. 9, 2002

(65) Prior Publication Data

US 2003/0049965 A1 Mar. 13, 2003

(30) Foreign Application Priority Data

Sep. 7, 2001 (JP) ..... 2001-272453
Jun. 6, 2002 (JP) ..... 2002-166360
Jun. 24, 2002 (JP) ..... 2002-183604

(51) Int. Cl.[7] ..... H01R 13/40
(52) U.S. Cl. ..... 439/595; 439/852; 439/748
(58) Field of Search ..... 439/595, 839, 439/748, 825, 828, 829, 851, 746, 744, 7, 752.6, 872

(56) References Cited

U.S. PATENT DOCUMENTS 4,047,791 A * 9/1977 Carter ..... 439/828
4,781,628 A * 11/1988 Detter et al. ..... 439/748
5,643,018 A * 7/1997 Sakai et al. ..... 439/595
5,695,368 A * 12/1997 Joly et al. ..... 439/748
5,911,603 A * 6/1999 Mansutti ..... 439/748
5,954,548 A * 9/1999 Stabroth ..... 439/839
6,174,208 B1 * 1/2001 Chen ..... 439/752.5
6,193,551 B1 * 2/2001 Yamamoto et al. ..... 439/595
6,244,910 B1 * 6/2001 Grubbs ..... 439/595
6,322,391 B1 * 11/2001 Kodama ..... 439/595
6,375,501 B1 * 4/2002 Kojima ..... 439/595
6,527,601 B2 * 3/2003 Chen ..... 439/851

FOREIGN PATENT DOCUMENTS

DE 43 12 641 A1 10/1994
DE 197 41 346 A1 3/1999
FR 2 769 413 4/1999

* cited by examiner

*Primary Examiner*—Dean Reichard
*Assistant Examiner*—Angel R. Estrada
(74) *Attorney, Agent, or Firm*—Anthony J. Casella; Gerald E. Hespos

(57) ABSTRACT

A terminal fitting (30) has a rectangular tubular main body (31) with a ceiling wall (33), first and second sidewalls (34, 35) extending down from the opposite sides of the ceiling wall (33), a bottom wall (36) projecting from the first sidewall (34) to face the ceiling wall (33), and an outer wall (37) projecting from the second side wall (35) and placed on the outer side of the bottom wall (36). A front-portion holding piece (50) projects from a front portion (37*a*) of the outer wall (37) and engages a front-portion holding groove (51) in the first sidewall (34). A restrictable projection (70) is provided at the rear end of the front-portion holding piece (50), and engages a restricting groove (71) of the front-portion holding groove (51) for restricting an opening deformation of the outer wall (37).

10 Claims, 15 Drawing Sheets

TERMINAL FITTING, CONNECTOR PROVIDED THEREWITH AND METHOD FOR PRODUCING THE TERMINAL FITTING

BACKGROUND OF THE INVENTION

1. Field of the Invention

The invention relates to a terminal fitting, to a connector provided with a terminal fitting and to a method for producing such a terminal fitting.

2. Description of the Related Art

Japanese Unexamined Patent Publication No. 4-209471 and in FIG. 14 herein show a terminal fitting with a long narrow bottom wall 1, and right and left sidewalls 2, 3 that extend up from opposite sides of the bottom wall 1. A ceiling wall 4 projects from the upper end of the right sidewall 2 to face the bottom wall 1 and an outer wall 5 projects from the upper end of left sidewall 3. The outer wall 5 is placed on the outer side of the ceiling wall 4 such that the projecting end of the outer wall 5 abuts against the upper end of the right sidewall 2. The bottom wall 1, the sidewalls 2, 3, the ceiling wall 4 and the outer wall 5 define a rectangular tubular main body 6.

The outer wall 5 cantilevers from the left sidewall 3 and may be deformed outward in response to certain external forces. As a result, the main body 6 will no longer retain its rectangular tubular shape.

The present invention was developed in view of the above problem and an object thereof is to hold a main body in a specified shape.

SUMMARY OF THE INVENTION

The invention relates to a terminal fitting with a main body formed into a substantially rectangular tube. At least one holding piece projects from one wall of the main body and engages in a holding groove formed in another wall of the main body. Thus, the walls of the main body resist external forces and are prevented from moving loosely along the longitudinal direction.

The holding piece comprises at least one restrictable portion and the holding groove comprises at least one restricting portion for engaging the restrictable portion and restricting an opening deformation of the wall. Thus, the main body can hold the shape of a substantially rectangular tube even if external forces act on the main body. The restrictable portion and the restricting portion may be provided respectively at the rear ends of the holding piece and the holding groove.

The wall with the holding piece can engage a fastener in a connector housing for locking the terminal fitting in the housing. A force could pull the terminal fitting back while the fastener in the housing engages the wall that has the holding piece. This force acts to twist the rear end of the wall relative to the front end. However, the restrictable portion and the restricting portion engage one another at the rear ends of the holding piece and the holding groove and resist a twisting displacement of the wall. Thus, the fastener stably locks the terminal fitting.

The wall that has the holding piece preferably is cut away, and the fastener engages a cut end surface of the cut-away portion. Thus, the cut-away portion divides the wall into front and rear portions. The holding piece and the restrictable portion may be provided at the front portion of the wall where the fastener is engageable.

The fastener engages the front cut end surface of the cut-away portion to lock the terminal fitting in the housing. Thus, a large engaging area with the fastener is ensured, and a sufficient locking force can be obtained even if the terminal fitting is small.

The cut-away portion weakens the wall. Thus, the front portion engaged with the fastener could move loosely along the longitudinal direction and could twist due to reduced strength. However, the holding piece and the restrictable portion prevent such loose movements and twisting. Accordingly, the terminal fitting is suited to being miniaturized.

An auxiliary restrictable portion may be at the front end of the holding piece, and an auxiliary restricting portion may be in the holding groove for engaging the auxiliary restrictable portion and restricting the opening deformation of the wall that has the holding piece. A twisting deformation of the wall that has the holding piece is restricted by the engagement of the auxiliary restricting portion with the auxiliary restrictable portion as well as by the engagement of the restricting portion with the restrictable portion.

The wall that has the holding groove and the restricting portion preferably is formed with a reinforcing bead. The reinforcing bead offsets the weakening of the wall attributable to the formation of the holding groove.

The invention also is directed to a connector with a housing that has at least one cavity. At least one of the above-described terminal fittings is inserted into the cavity. The wall of the terminal fitting that has the holding piece preferably can lock the terminal fitting by engaging a fastener of the housing when the terminal fitting is inserted into the housing.

The invention also is directed to a method for producing a terminal fitting. The method comprises providing a base member having a specified shape and forming the base member into a rectangular tubular main body. At least one holding piece projects from one wall of the main body and the method comprises engaging the holding piece in a holding groove or recess in another wall. Thus, the walls that have the holding piece and the holding groove are prevented from being loosely moved along the longitudinal direction.

The holding piece preferably is formed to comprise at least one restrictable portion and the holding groove is formed to comprise at least one restricting portion. The method then comprises bringing the holding piece into engagement with the restrictable portion for restricting an opening deformation of the wall that has the holding piece. The restrictable portion and the restricting portion preferably are at the rear ends of the holding piece and the holding groove, respectively.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a first embodiment of the invention includes a female housing 10 in which female terminal fittings 30 are inserted, as shown in FIGS. 1 to 12. The female terminal fittings 30 are electrically connectable with male terminal fittings in a mating male housing (not shown). In the following description, directions IWD of inserting and withdrawing the female terminal fittings 30 into and from the female housing 10 are referred to as a forward direction and a backward direction, respectively, and reference is made to FIG. 4 concerning the vertical direction.

Figure 1:
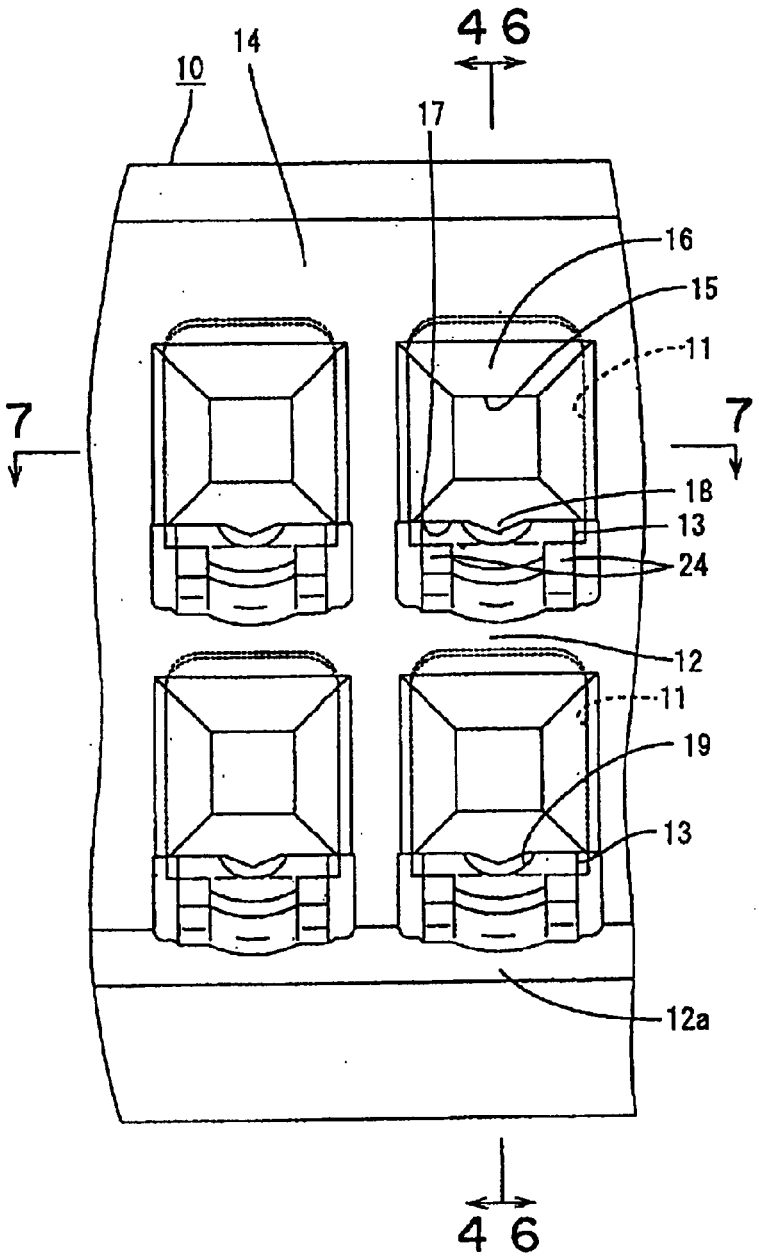
FIG. 1 is a front view of a female housing according to a first embodiment of the invention.
Figure 4:
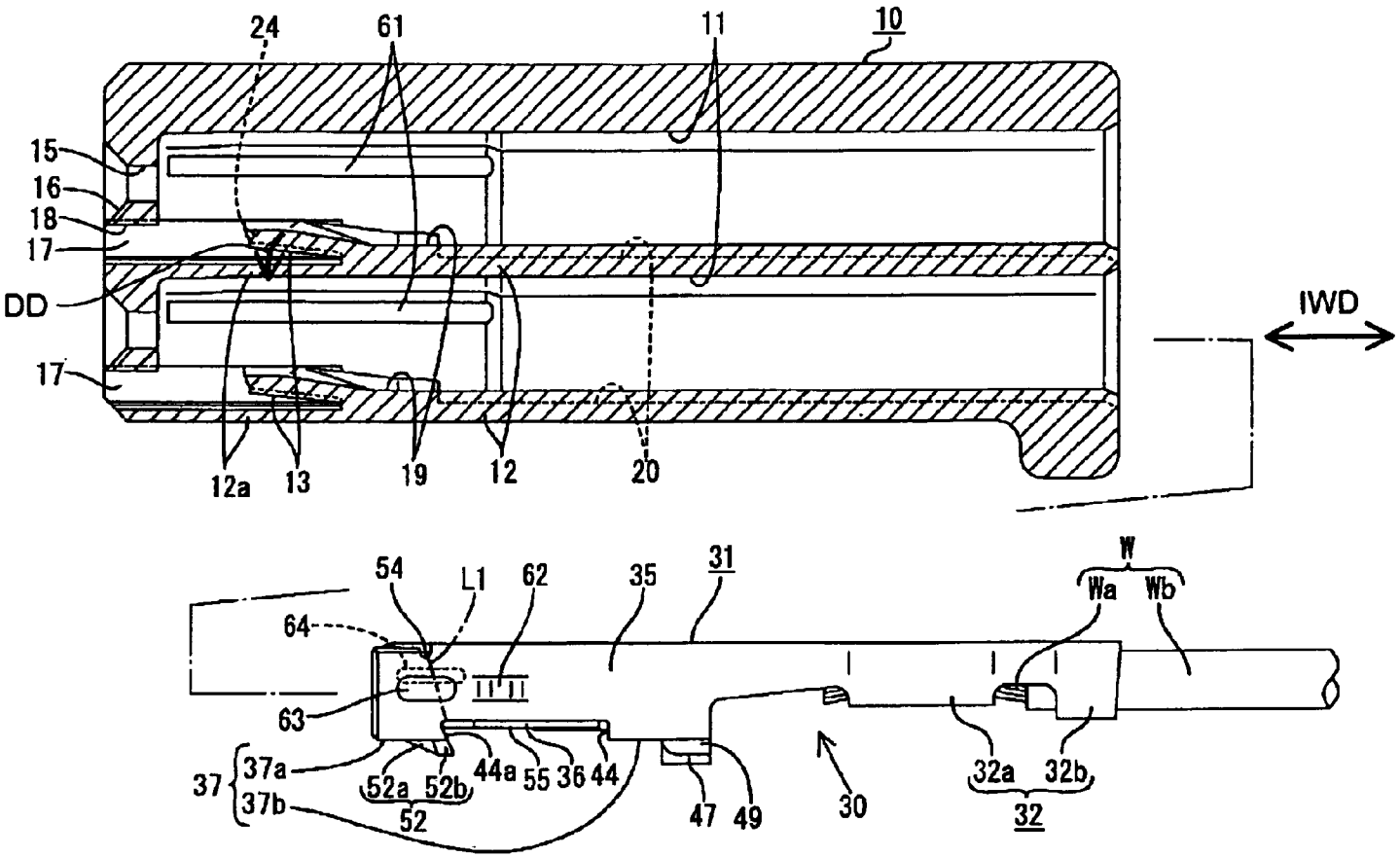
FIG. 4 is a cross sectional view of the housing taken along line 4—4 of FIG. 1 and a side view of the female terminal fitting before the female terminal fitting is inserted into the housing.

The female housing 10 has cavities 11 for receiving the female terminal fittings 30 that have been inserted from behind along the inserting and withdrawing directions IWD. The cavities 11 are arranged substantially side by side along the widthwise direction at two stages, as shown in FIGS. 1 and 4. The female terminal fitting 30 inserted into the cavity 11 can be locked by a resilient lock 13 that projects from a bottom wall 12 of the cavity 11. Additionally, the female terminal fitting 30 can be supported at its front-limit position by the front wall 14 of the housing 10. The front wall 14 of the housing 10 has tab insertion holes 15 for permitting tabs of the mating male terminal fittings to be inserted into the cavities 11 from the front. Tapered guide surfaces 16 are formed at the front edges of the tab insertion holes 15 and extend around the periphery, so that the tabs can be guided smoothly into the tab insertion holes 15. Mold-removal holes 17 are formed in the front wall 14 at positions below the tab insertion holes 15 and are used to remove the front mold for forming the lock 13 at the time of molding the female housing 10. A substantially triangular projection 18 projects down at the widthwise center of the upper end of each mold-removal hole 17 in the front wall 14. The guide surface 16 also is formed continuously at the projecting portion 18.

About ¼ of a front portion of the bottom wall 12 of each cavity 11 is stepped down to form a recessed section 12*a*. The lock 13 is cantilevered forward and up into the cavity 11 from a portion of the bottom wall 12 rearward of the recessed section 12*a*. Thus, in an unbiased condition, the front of the lock 13 is above the recessed section 12*a*. However, the lock 13 can deform down in a deformation direction DD that intersects the inserting and withdrawing directions IWD. Downward deformation of the lock 13 is generated in response to forces exerted by the female terminal fitting 30 as the female terminal fitting 30 is inserted into the cavity 11. The resiliently deformed lock 13 retracts into a deformation permitting space defined above the recessed section 12*a* of the bottom wall 12. The recessed section 12*a* of the bottom wall 12 faces the lock 13 from below and prevents the lock 13 from deforming beyond its resilient limit. Additionally, the recessed section 12*a* of the bottom wall 12 covers the lock 13 from below, and protects the lock 13 from exposure to the cavity 11 below or from the outside below the female housing 10. Thus, the lock 13 and the cavity 11 are protected.

Figure 7:
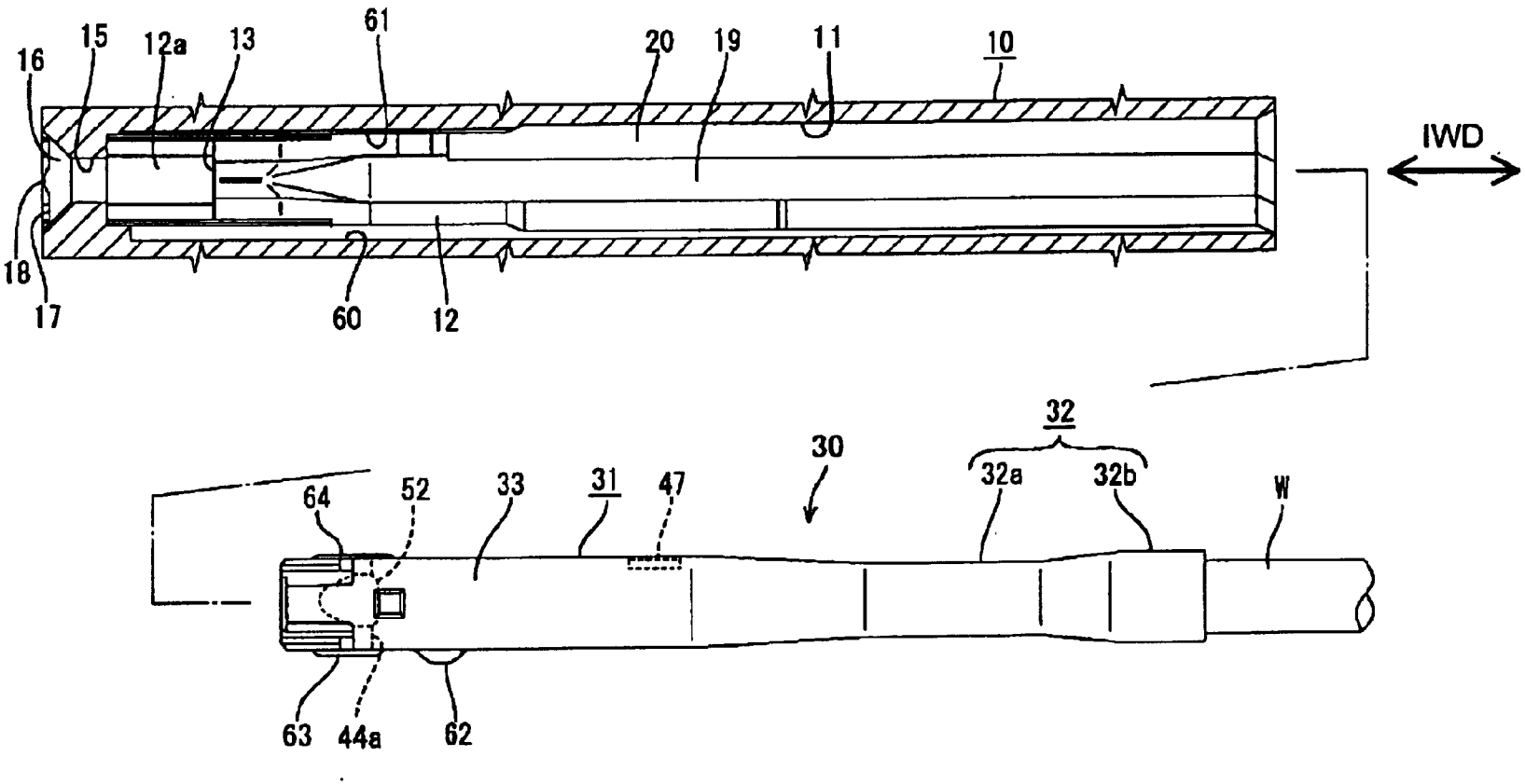
FIG. 7 is a cross sectional view of the housing taken along 7—7 of FIG. 1 and a plan view of the female terminal fitting before the female terminal fitting is inserted into the housing.

A projection-inserting groove 19 and a stabilizer-inserting groove 20 are formed in a portion of the bottom wall 12 of the cavity 11 behind the lock 13, as shown in FIG. 7, for receiving projections on the female terminal fitting 30. The stabilizer-inserting groove 20 is deeper than the projection-inserting groove 19 and is formed at the back of the projection-inserting groove 19, as shown in FIG. 7. The projection-inserting groove 19 is continuous with the front end of the lock 13, whereas the front end of the stabilizer-inserting groove 20 is slightly behind the lock 13. The bottom wall 12, the projection-inserting groove 19 and the stabilizer-insertion groove 20 define a stair-shape in the widthwise direction.

Two forwardly open maneuverable recesses 24 are formed at opposite sides of the lower front end of the lock 13 and extend to about ⅗ of the total height of the lock 13. The maneuverable recesses 24 are arranged to be exposed forward to the outside even if the female terminal fitting 30 is locked by the lock 13, and can be pressed down in the deformation direction DD by a disengagement jig inserted through the mold-removal hole 17. Each maneuverable recess 24 is substantially triangular when the lock 13 is viewed sideways. The upper surface of each maneuverable recess 24 is substantially horizontal, whereas the lower surface is inclined up and to the back.

Figure 3:
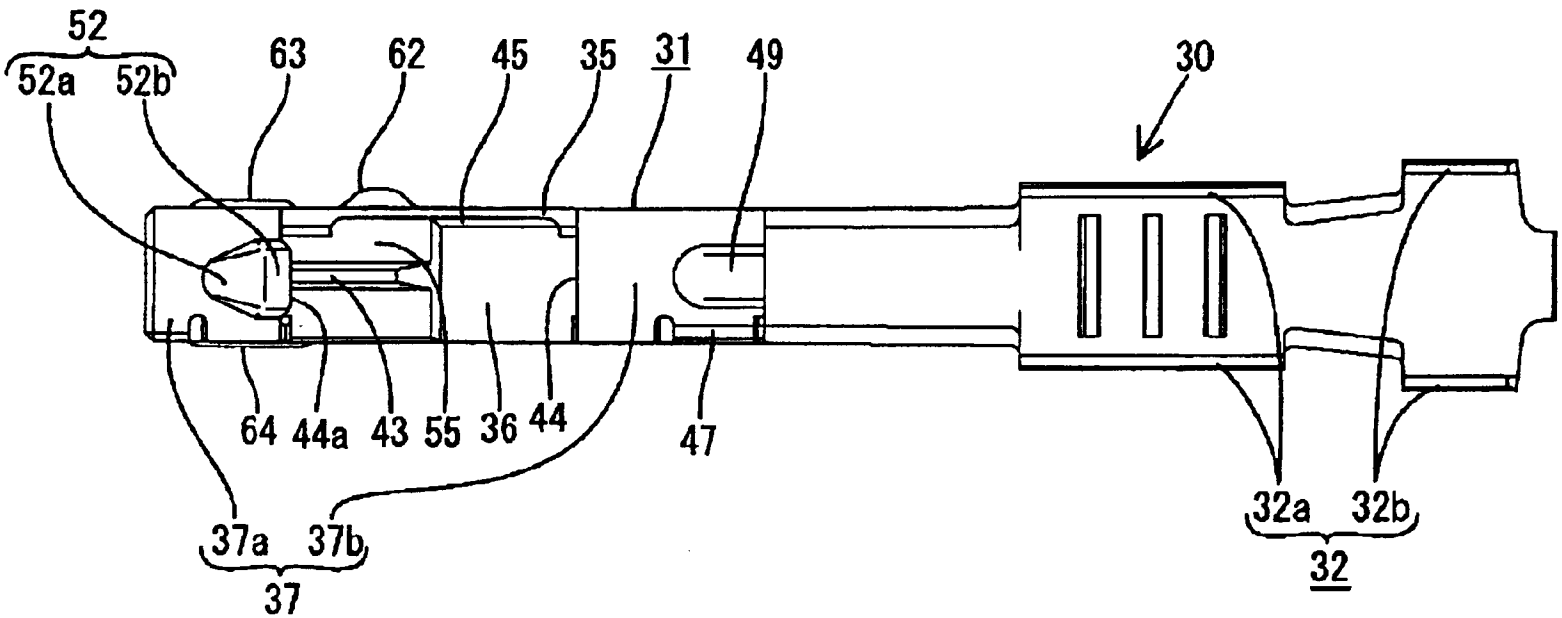
FIG. 3 is a bottom view of the female terminal fitting.

The female terminal fitting 30 is formed into a desired shape by embossing, folding and/or bending a metallic material stamped or cut into a specified shape. The female terminal fitting 30, as shown in FIGS. 3 and 4, has a main body 31 and a barrel 32 rearward of the main body 31. The barrel 32 has front crimping pieces 32*a* crimped, bent or folded into connection with a core Wa of a wire W, and rear crimping pieces 32*b* crimped, bent or folded into connection with an insulated portion Wb of the wire W.

Figure 2:
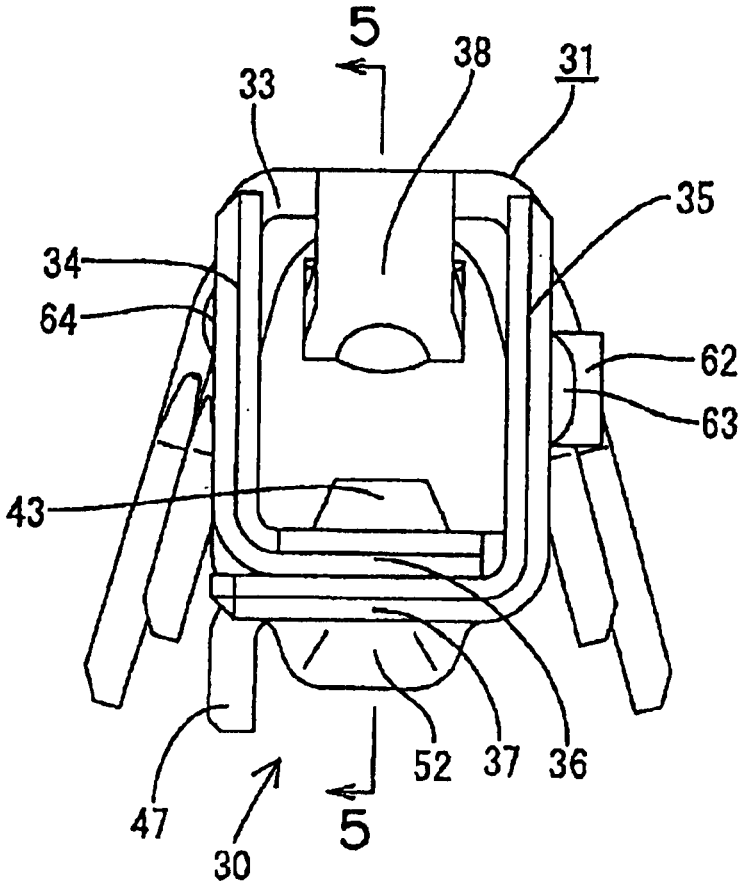
FIG. 2 is a front view of a female terminal fitting.

The main body 31 is a substantially rectangular tube, as shown in FIG. 2, and has an elongate ceiling wall 33 that extends in forward and backward directions. Sidewalls 34, 35 extend down from the opposite lateral edges of the ceiling wall 33. A bottom wall 36 projects from the bottom end of the left sidewall 34 of FIG. 2 and faces the ceiling wall 33. An outer wall 37 projects from the bottom end of the right side wall 34 of FIG. 2 and is below and outside of the bottom wall 36.

Figure 5:
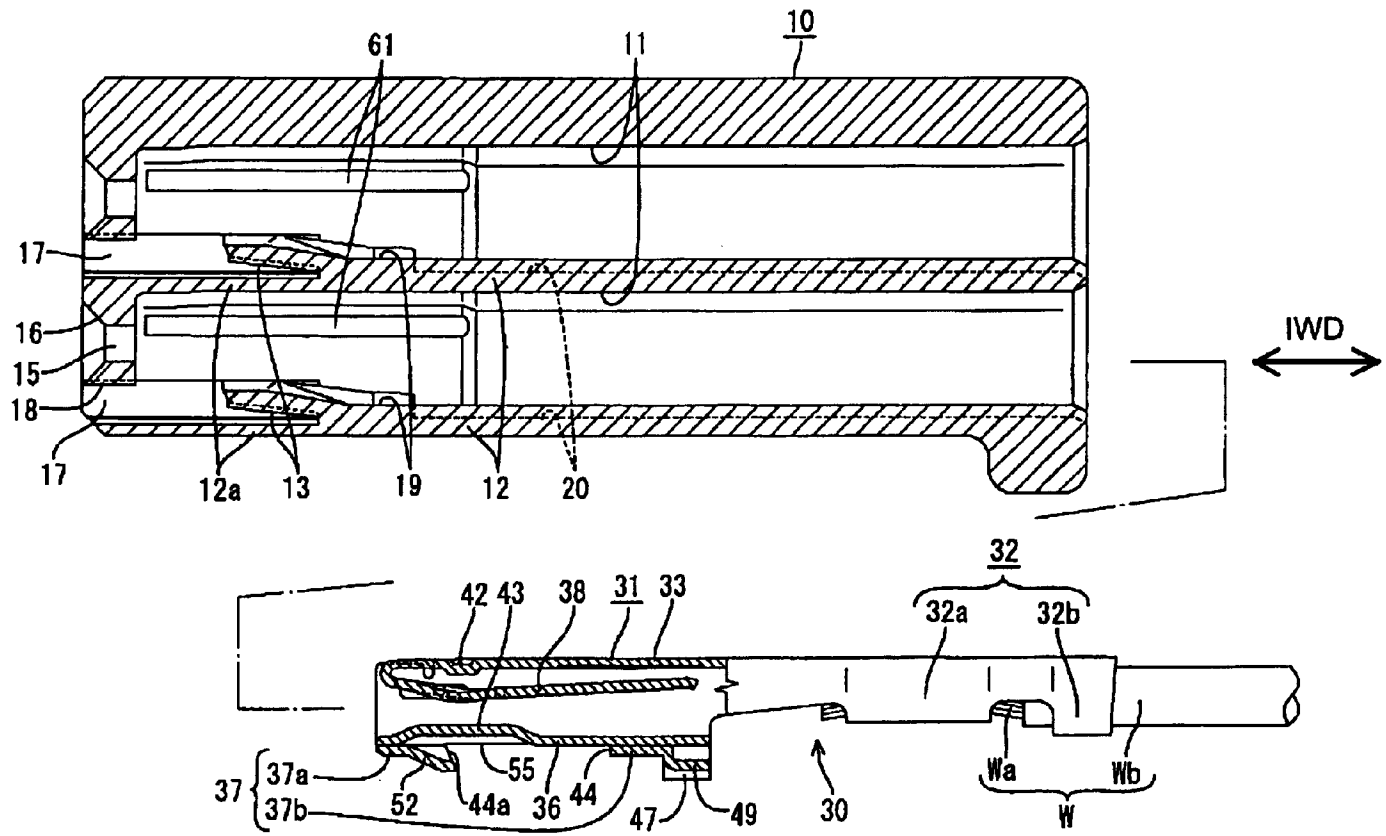
FIG. 5 is a cross sectional view of the housing taken along line 4—4 of FIG. 1 and a cross section view of the female terminal fitting taken along line 5—5 of FIG. 2 before the female terminal fitting is inserted into the housing.

The front end of the ceiling wall 33 is retracted back as compared to the other walls 34, 35, 36 and 37. A resilient contact piece 38 projects from the front end of the ceiling wall 33, as shown in FIG. 5, and is folded back and bent into a substantially triangular bent shape. The resilient contact piece 38 can be brought resiliently into contact with the tab of the mating male terminal fitting inserted into the main body 31 from the front. A receiving portion 43 bulges up from the bottom wall 36 and faces the resilient contact piece 38 so that the tab can be squeezed between the receiving portion 43 and the resilient contact piece 38. An excessive deformation-preventing portion 42 is formed by embossing the ceiling wall 33 inward and engages the resilient contact piece 38 before the resilient contact piece 38 is deformed beyond its resilient limit.

Figure 6:
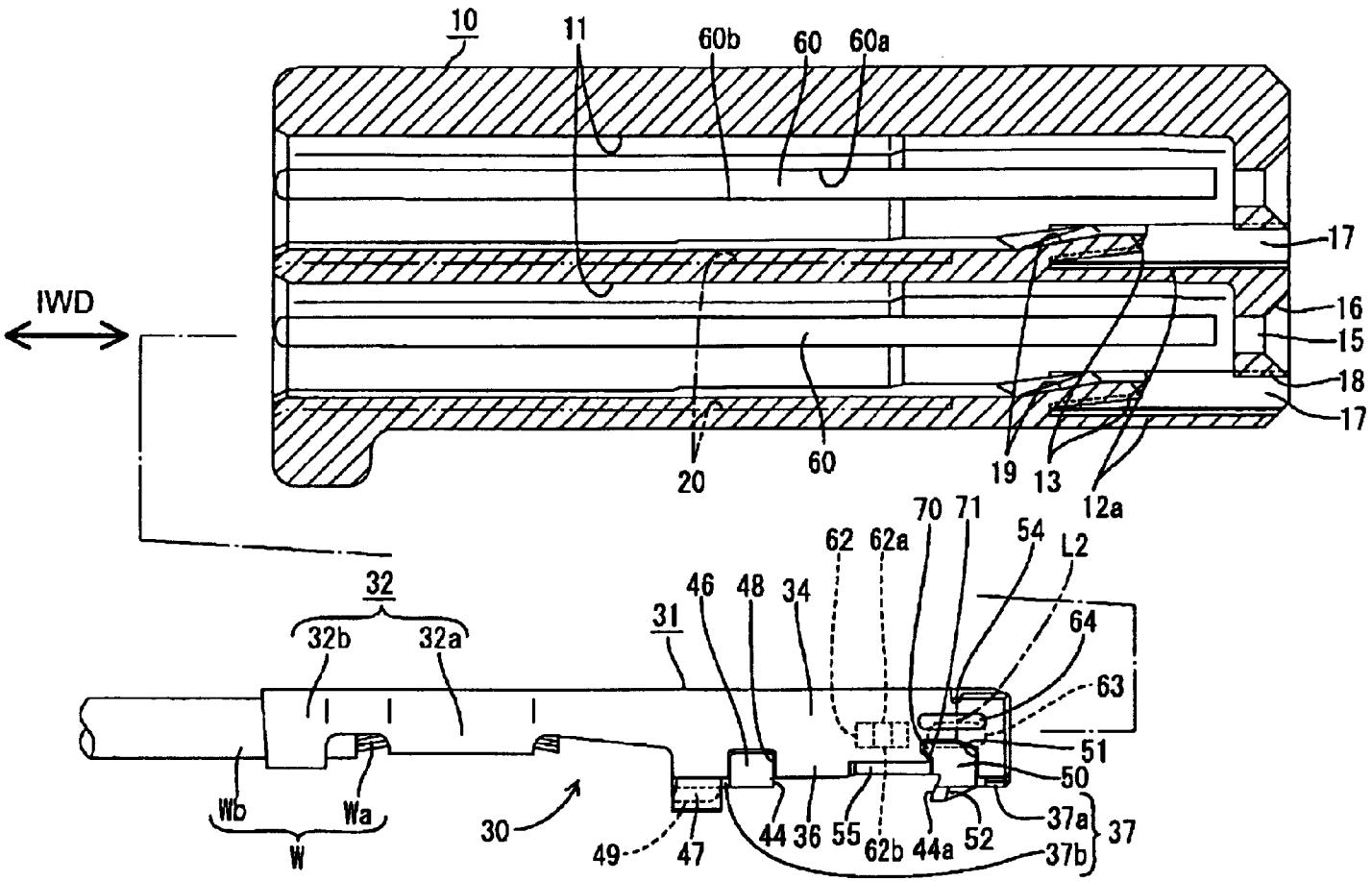
FIG. 6 is a cross sectional view of the housing taken along 6—6 of FIG. 1 and a side view of the female terminal fitting showing the state before the female terminal fitting is inserted into the housing.

A cut-away portion 44 is formed over substantially the entire width of the outer wall 37 to divide the outer wall 37 into a front portion 37*a* and a rear portion 37*b* that is slightly longer than the front portion 37*a*, as shown in FIGS. 3 and 5. The lock 13 enters the cut-away portion 44 over its entire length when the female terminal fitting 30 is inserted in the cavity 11 and hence the lock 13 engages a front cut surface 44*a* of the cut-away portion 44. The front cut surface 44*a* of the cut-away portion 44 is inclined up and to the back over its entire area and defines a locking surface that engages the lock 13. The cut-away portion 44 has a length slightly less than half the length of the outer wall 37 and extends up to the bottom end of the sidewall 35 at the upper side in FIG. 3. A bulge 45 projects from the projecting end of the bottom wall 36 and contacts the bottom end surface of the sidewall 35 to hold the bottom wall 36 substantially horizontal. The front half of the bottom wall 36, including the receiving portion 43, has a recess 55 that is slightly lower than the rear half of the bottom wall 36. The recess 55 is formed over substantially the entire area including a portion of the bulge 45 that contacts the sidewall 35. The recess 55 enlarges the depth of engagement of the lock 13. The recess 55 is formed over the area extending to the upper end of the side wall 34, and the rear end surface of the front-portion holding piece 50 substantially faces the recess 55 from the front as shown in FIG. 6.

A rear-portion holding piece 46 is bent in toward the ceiling wall 33 at the projecting end of the rear portion 37*b* of the outer wall 37 so that the front end of the rear-portion holding piece 46 substantially aligns with the front end of the rear portion 37*b*. The rear-portion holding piece 46 fits into a rear-portion holding groove 48 in the sidewall 34, as shown in FIG. 6, and prevents the rear portion 37*b* from making loose forward and backward movements. A stabilizer 47 is bent out from the rear portion 37*b* of the outer wall 37 rearward of the rear-portion holding piece 46. The stabilizer 47 is dimensioned to slide along the stabilizer-inserting groove 20 for guiding the female terminal fitting 30 into the cavity 11. The rear end of the stabilizer 47 and the rear end of the rear portion 37*b* substantially align with each other. A projection 49 is embossed to project out at the widthwise center of the rear end of the rear portion 37*b*, and has a length substantially equal to the length of the stabilizer 47. The projection 49 can be brought into contact with the bottom surface of the cavity 11 when the female terminal fitting 30 is inserted into the cavity 11.

A locking projection 52 is embossed to project out from the rear of front portion 37*a* of the outer wall 37 at a position slightly displaced to the left of center in FIG. 2. The locking projection 52 has a pyramidal portion 52*a* formed by three slanted surfaces and a substantially rectangular tubular portion 52*b* that has a substantially constant width and height. The pyramidal portion 52*a* of the locking projection 52 is tapered toward the front and has its front end slightly rounded, as shown in FIGS. 3 and 4, so that the locking projection 52 slides smoothly into the projection-inserting groove 19 as the female terminal fitting 30 is inserted into the cavity 11. The rectangular tubular portion 52*b* of the locking projection 52 projects back substantially along the inclination of the front cut end surface 44*a* of the cut-away portion 44 and projects back further than the front portion 37*a* of the outer wall 37. The locking projection 52 is at the front of the cut-away portion 44 and is engageable with the lock 13.

The locking projection 52 projects to substantially the same height as the projection 49, and is insertable into the projection-inserting groove 19 of the cavity 11. The rear end 52*c* of the locking projection 52 is formed by the front cut end surface 44*a* of the cut-away portion 44 and inclines up and to the back for engagement with the lock 13. The rear end surfaces of the front portion 37*a* of the outer wall 37 at opposite sides of the locking projection 52 also are formed by the front cut end surface 44*a* of the cut-away portion 44 and incline up and to the back for engagement with the lock 13.

A front-portion holding piece 50 is at the end of the front portion 37*a* of the outer wall 37 that abuts the side wall 34, and is bent toward the ceiling wall 33, as shown in FIG. 6. The front-portion holding piece 50 is fit in a front-portion holding groove 51 in the side wall 34, as shown in FIG. 6, and prevents the front portion 37*a* from making loose forward and backward movements. Additionally, the front-portion holding piece 50 projects more back than the front portion 37*a* of the outer wall 37. The cut-away portion 44 extends into the base end of the front-portion holding piece 50, and the cut end surface 44*a* thereof is inclined in and up to the back, as described above. A side end of the lock 13 is engageable with the cut end surface 44*a*.

A restrictable projection 70 projects back from the projecting end of the front-portion holding piece 50, and a restricting groove 71 is formed at the upper rear end of the front-portion holding groove 51. Lower surfaces of the restricting projection 70 and the restricting groove 71 slant forward. Thus, the restricting projection 71 is substantially triangular and has an acute angle oriented back in the terminal fitting 30. Accordingly, the restrictable projection 70 and the restricting groove 71 have complementary shapes. Upper front surfaces of the front-portion holding piece 50 and the front-portion holding groove 51 slant forward. The front-portion 37*a* is bent relative to the side wall 35, and then the front-portion holding piece 50 is bent with respect to the front portion 37*a* to fit the front-portion holding piece 50 into the front-portion holding groove 51 and to fit the restrictable projection 70 into the restricting groove 71. The lower surface of the restrictable projection 70 engages the lower surface of the restricting groove 71 when the restrictable projection 70 is fit into the restricting groove 71. Thus, a force to open the front portion 37*a* of the outer wall 37 outward is restricted.

The side wall 34 is embossed above the front-portion holding groove 51 and the restricting groove 71 to project out and to form an elliptical second bead 64 that is long in forward and backward directions. The second bead 64 reinforces the sidewall 34. The surface of the front half of the cavity 11 at the backside of FIG. 4 is recessed to form a rearwardly open escaping groove 61 for escaping the second bead 64 during insertion of the female terminal fitting 30. The escaping groove 61 has an arcuate shape that conforms to the second bead 64, and is slightly above the center of the side surface of the cavity 11.

The female connector has means for preventing the female terminal fitting 30 from inclining vertically in the cavity 11. In particular, a supporting groove 60 with an open rear end is formed in the cavity 11, as shown in FIG. 6. The supporting groove 60 has a substantially rectangular shape, and is substantially at the middle of the side surface of the cavity 11 with respect to the vertical direction. The front end of the supporting groove 60 is slightly rearward from the front surface of the cavity 11. Upper and lower surfaces 60*a*, 60*b* of the supporting groove 60 extend transversely and are substantially normal to the deforming direction DD of the lock 13.

The supportable projection 62 is embossed to project out from the right sidewall 35 of the main body 31, as shown in FIG. 2. Front and rear ends of the supportable projection 62 are coupled to the sidewall 35, such that the front surface of the supportable projection 62 is inclined back and the rear surface thereof is inclined forward. Upper and lower surfaces 62*a*, 62*b* of the supportable projection 62 are separated from the sidewall 35 and extend substantially horizontally along forward and backward directions. The supportable projection 62 is fittable into the supporting groove 60 when the terminal fitting 30 is inserted into the cavity 11, so that the upper and lower surfaces 62*a*, 62*b* of the supportable projection 62 engage the upper and lower surfaces 60*a*, 60*b* of the supporting groove 60 (see FIG. 11). Additionally, the inclined front and rear ends of the supportable projection 62 ensure smooth movement of the supportable projection 62 into and out of the supporting groove 60. The supportable projection 62 is substantially vertically centered on the sidewall 35, and is slightly more forward than the center with respect to forward and backward directions, but behind the locking projection 52. A vertical dimension or height of the supportable projection 62 is about ¼ of that of the main body 31. An elliptical or rounded first bead 63 is embossed to project out from-the sidewall 35 at a position before the supportable projection 62 and is elongated in forward and backward directions. The first bead 63 reinforces the sidewall 35, and is vertically within a width range of the supportable projection 62. An outward-projecting height of the first bead 63 is less than that of the supportable projection 62. Thus, the first bead 63 can be inserted into the supporting groove 60 when the female terminal fitting 30 is inserted into the cavity 11.

The sidewalls 34, 35 extend more forward than the ceiling wall 33, as described above. Additionally, the sidewalls 34, 35 are bent down from the ceiling wall 33 in the process of forming the female terminal fitting 30. Upward-opening slits 54 are formed in the sidewalls 34, 35 substantially at the ceiling wall 33 to prevent bending on the extended portions of the sidewalls 34, 35 (see FIGS. 4 and 6). The slits 54 reduce the strength of the sidewalls 34, 35. However, the first bead 63 is on a virtual straight line L1 connecting the slit 54 of the sidewall 35 and the cut-away portion 44 and the second bead 64 is on a virtual straight line L2 connecting the slit 54 of the side wall 34 and the front-portion holding groove 51. Thus, the first bead 63 at least partly offsets the reduced strengths of the sidewalls 34, 35.

Figure 8:
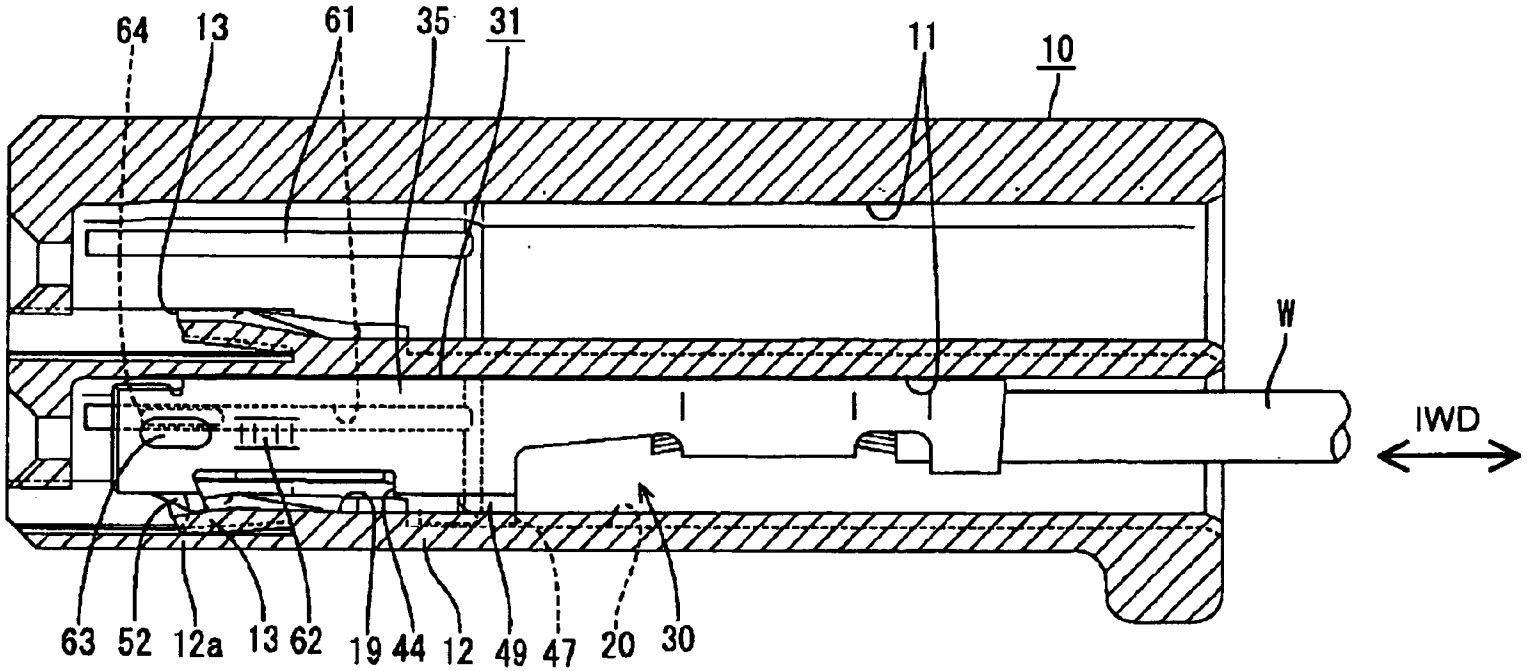
FIG. 8 is a cross sectional view of the housing taken along line 4—4 of FIG. 1 and a right side view of the female terminal fitting at an intermediate stage of insertion into the housing.
Figure 9:
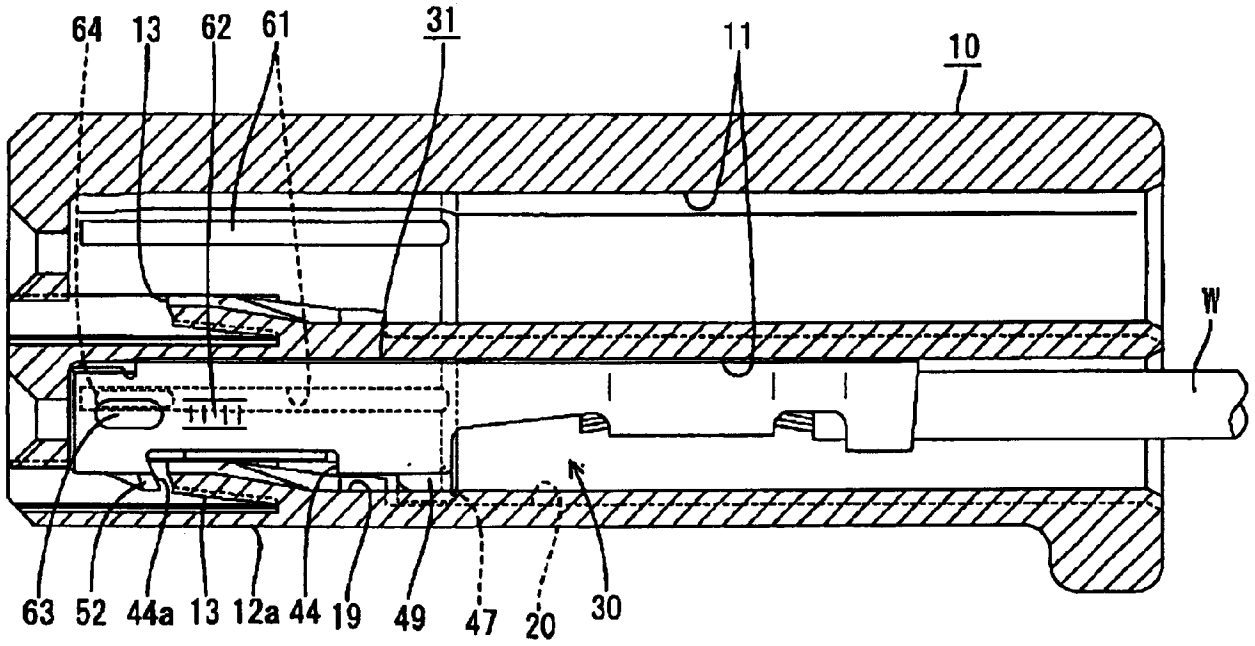
FIG. 9 is a cross sectional view of the housing taken along 4—4 of FIG. 1 and the female terminal fitting inserted in the housing.
Figure 10:
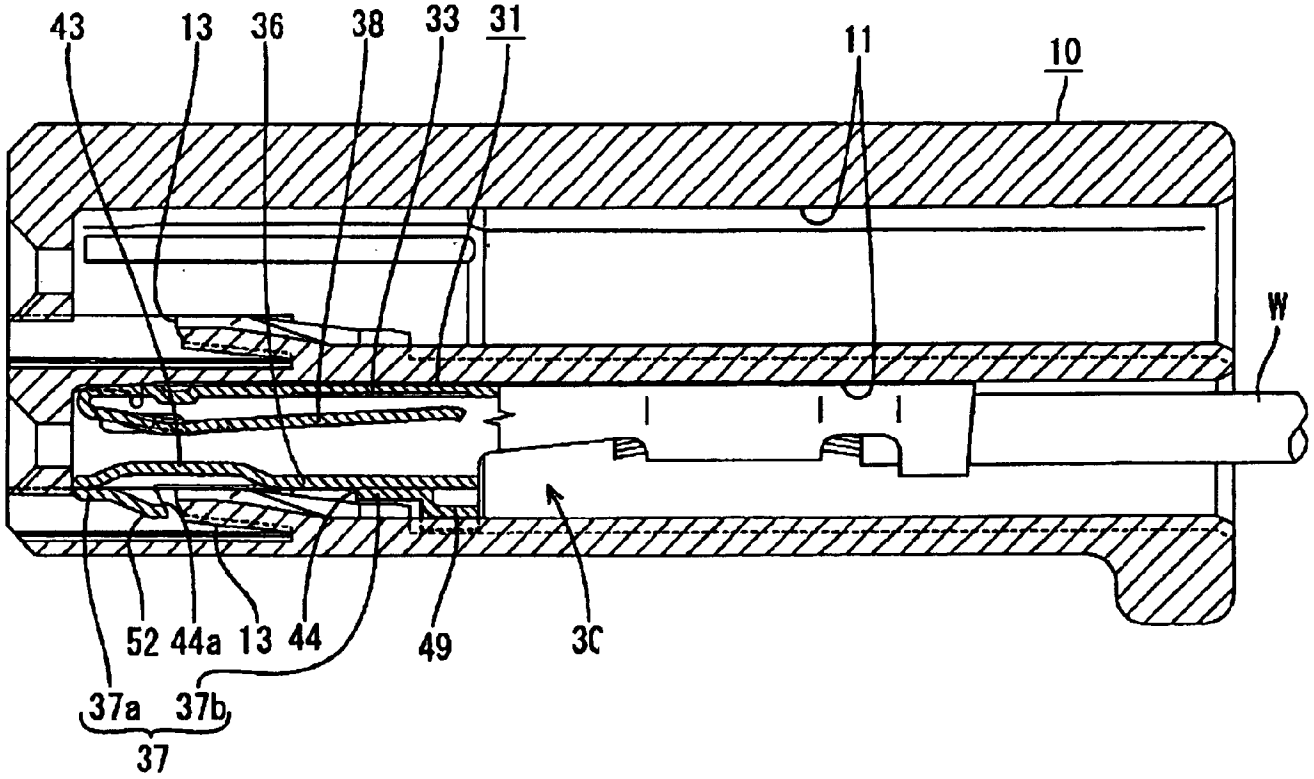
FIG. 10 is a cross sectional view of the housing taken along 4—4 of FIG. 1 and a cross sectional view of the female terminal fitting taken along line 5—5 of FIG. 2, and showing the female terminal fitting inserted in the housing.
Figure 11:
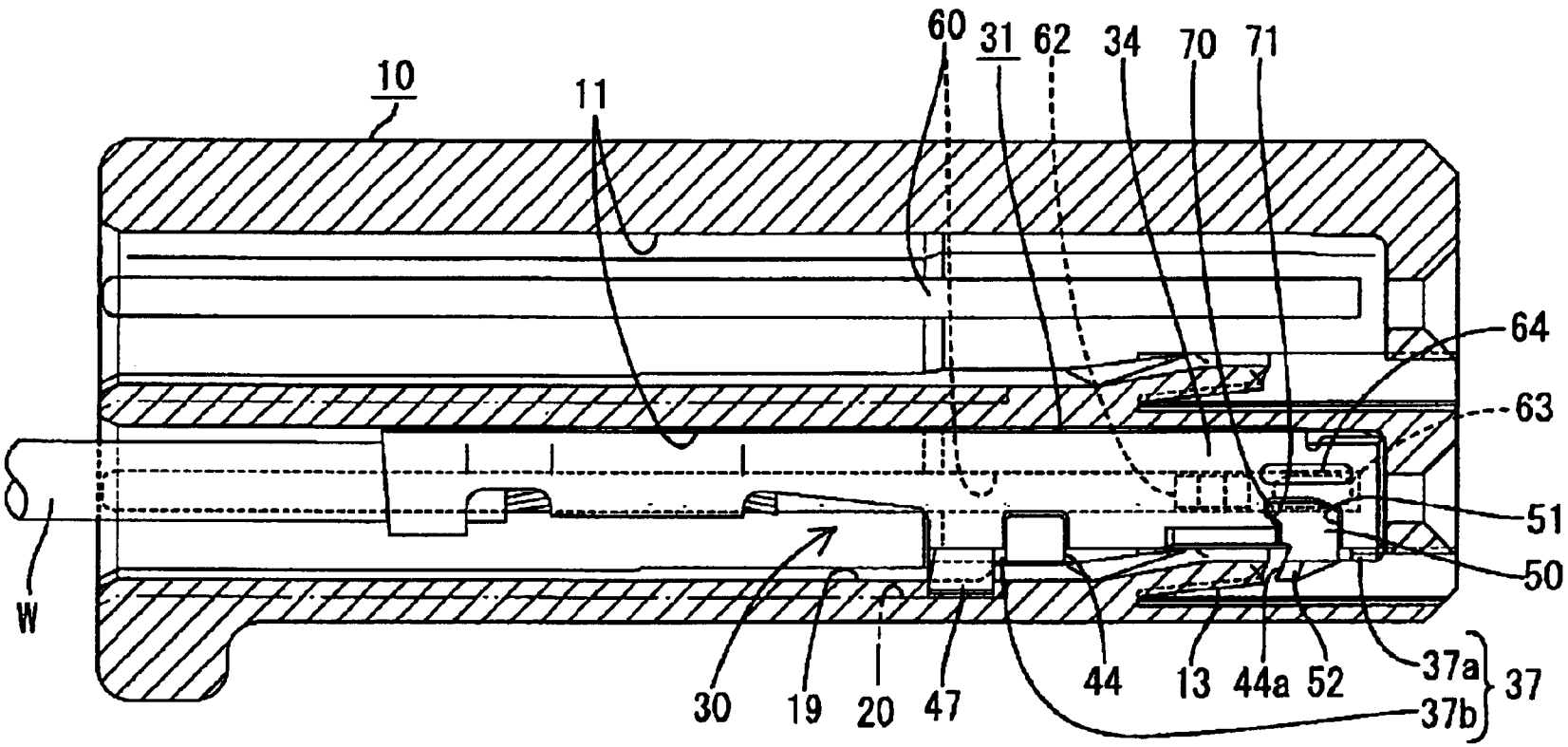
FIG. 11 is a cross sectional view of the female taken along 5—5 of FIG. 1 and a side view of the female terminal fitting.
Figure 11A:
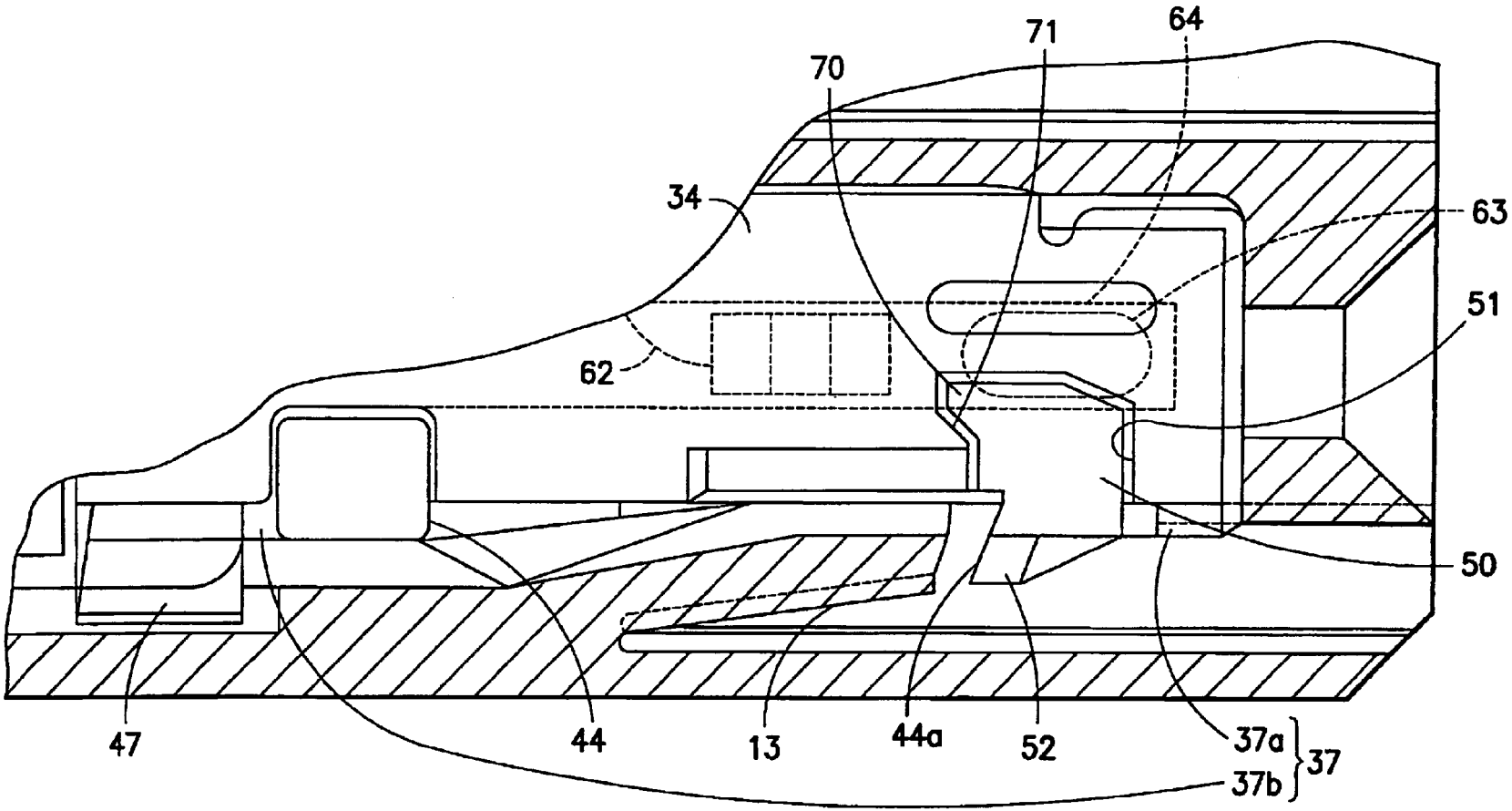
FIG. 11A is an enlarged plan view showing the engagement of the holding piece and the holding groove.
Figure 12:
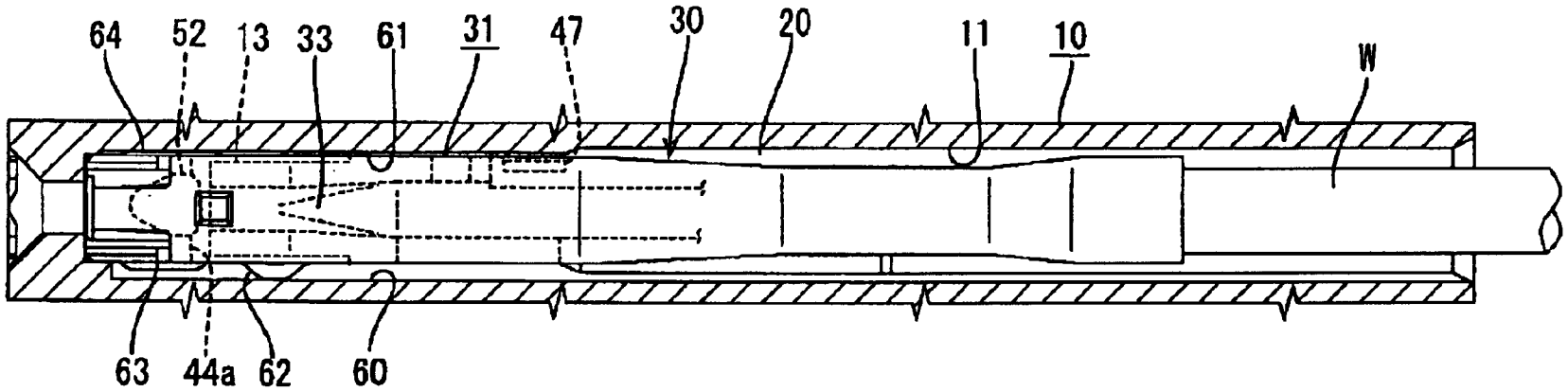
FIG. 12 is a cross sectional view of the housing taken along line 5—5 of FIG. 1 and the female terminal fitting is shown by a plan view of the female terminal fitting is inserted in the housing.

The barrel 32 of the female terminal fitting 30 is crimped into connection with the wire W and the female terminal fitting 30 then is inserted into the cavity 11 from behind, as shown in FIGS. 4 to 7. As a result, the locking projection 52 enters the projection-inserting groove 19, the second bead 64 enters the escaping groove 61, and the first bead 63 and the supportable projection 62 successively enter the supporting groove 60. The projection 49 and the stabilizer 47 then enter the projection-inserting groove 19 and the stabilizer-inserting groove 20, respectively. Consequently, the female terminal fitting 30 enters the cavity 11 smoothly and is prevented from shaking along vertical and transverse directions. When the female terminal fitting 30 is inserted to a specified depth, the locking projection 52 engages the front part 13*a* of the lock 13 and deflects the lock 13 down in the deforming direction DD, as shown in FIG. 8. The locking projection 52 has a pyramidal shape with a vertex at the front. Thus, the locking projection 52 can be inserted smoothly along the projection-inserting groove 19 and smoothly presses the lock 13.

The locking projection 52 moves beyond the lock 13 when the female terminal fitting 30 is inserted to a proper depth in the cavity 11. As a result, the lock 13 is restored resiliently and enters the cut-away portion 44 to lock the female terminal fitting 30, as shown in FIGS. 9 to 12. At this time, the front end of the lock 13 can enter the inside of the locking projection 52. In this state, the supportable projection 62 is fit in the supporting groove 60, and the upper and lower surfaces 60*a*, 60*b*, 62*a*, 62*b* of the supporting groove 60 and the supportable projection 62 are engaged with each other (see FIG. 11). Accordingly, the female terminal fitting 30 will not tilt vertically even if a pulling force acts on the wire W. Further, the upper and lower surfaces 62*a*, 62*b* of the supportable projection 62 are cut end surfaces that are separated from the sidewall 35 to extend substantially straight along horizontal direction of the terminal fitting 30. Thus, the female terminal fitting 30 can be supported firmly and inclination thereof can be prevented.

The front cut end surface 44*a* of the cut-away portion 44 is the locking surface that engages the lock 13 and extends over the entire width of the female terminal fitting 30. Thus the front cut end surface 44*a* reaches the front portion 37*a* of the outer wall 37, the locking projection 52 and the front-portion holding piece 50. Accordingly, the female terminal fitting 30 is held with a strong locking force and will not come out of the cavity 11 (see FIG. 12). Further, the locking force is even stronger because the front cut end surface 44*a* of the cut-away portion 44 is inclined up and to the back.

A backward force may be exerted on the wire W after the female terminal fitting 30 is locked in the cavity 11. The front portion 37*a* of the outer wall 37 is engaged directly with the lock 13, and is subjected to a force if the wire W is pulled rearwardly. Such a force tends to displace the entire front portion 37*a* forward and tends to twist the rear end of the front portion 37*a* down with the front end thereof as a supporting point. However, the front-portion holding piece 50 is fit in the front-portion holding groove 51 so that their respective front surfaces engage each other. Thus, the front portion 37*a* of the outer wall 37 cannot make loose forward movements with respect to the sidewall 34. Further, the restrictable projection 70 is fit in the restricting groove 71 so that their respective lower surfaces are engaged with each other. Thus, the front portion 37*a* of the outer wall 37 is prevented from undergoing a downwardly twisting opening deformation (see FIG. 11). As a result, the main body 31 can maintain its rectangular tubular shape, and the lock 13 holds the female terminal fitting 30 securely.

The cut-away portion 44 divides the outer wall 37 into the front and rear portions 37*a*, 37*b*. Thus, the lock 13 has a large engaging area and a sufficient locking force can be obtained even if the female terminal fitting 30 is small. However, the division of the outer wall 37 into the front and rear portions 37*a*, 37*b* by the cut-away portion 44 reduces the strength of the outer wall 37. As a result, the front portion 37*a* engaged with the lock 13 has a tendency to make loose longitudinal movements and to undergo a twisting deformation. However, such movement and twisting are prevented by the front-portion holding piece 50 and the restrictable projection 70, and the female terminal fitting 30 is well suited to being miniaturized.

The second bead 64 is provided to reinforce the sidewall 35. Thus, a reduction in the strength of the sidewall 34 caused by forming the front-portion holding groove 51 and the restricting groove 71 is offset.

Figure 13:
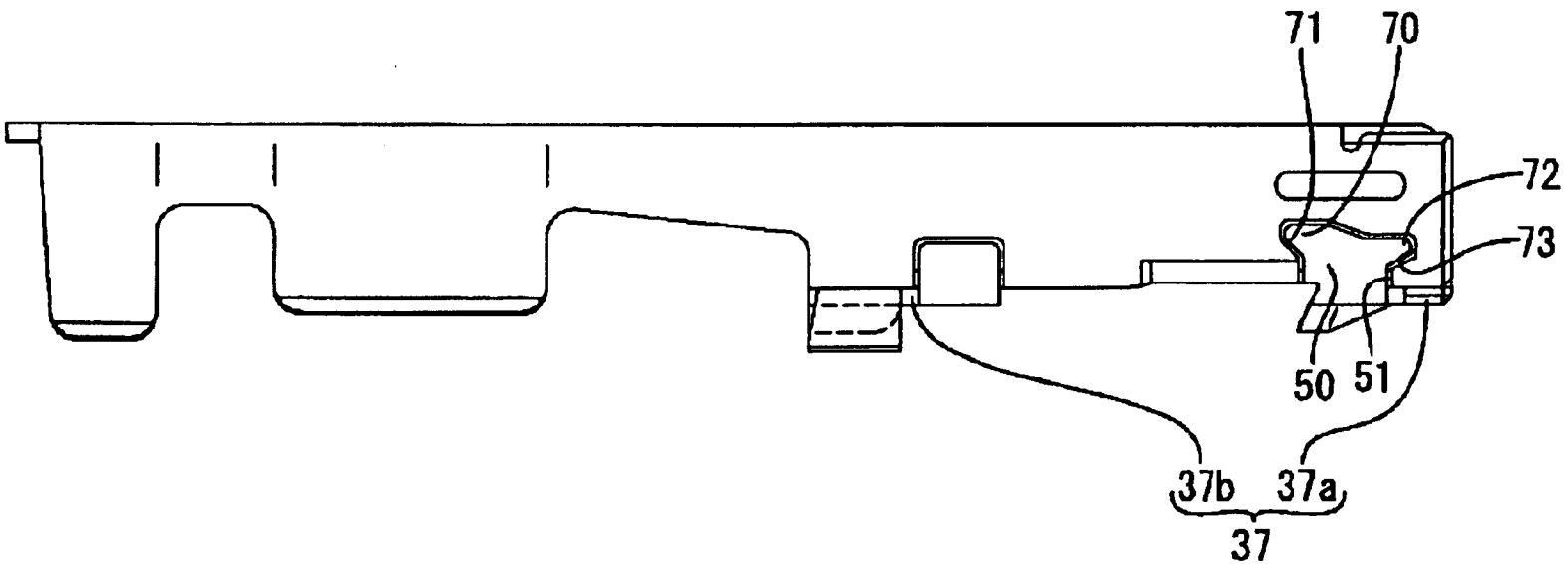
FIG. 13 is a left side view of a female terminal fitting according to a second embodiment of the invention.
Figure 14:
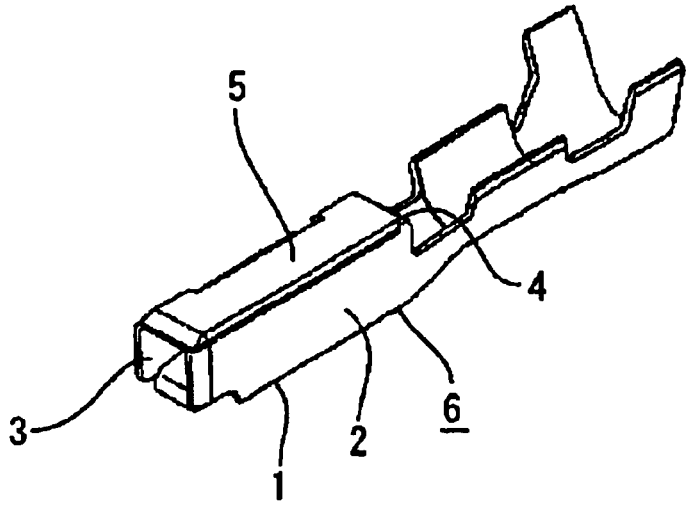
FIG. 14 PRIOR ART
FIG. 14 is a perspective view of a prior art terminal fitting.

A second embodiment of the invention is illustrated in FIG. 13, and is similar in many respects to the first embodiment. Accordingly no repetitive description is given for similar or identical components, and those components merely are identified by the same reference numerals as in the first embodiment. The connector of the second embodiment has an auxiliary restrictable projection 72 that projects forward from the upper front end of the front-portion holding piece 50. The auxiliary restrictable projection 72 is configured to engage an auxiliary restricting groove 73 at the upper front end of the front-portion holding groove 51. The lower surfaces of the auxiliary restrictable projection 72 and the auxiliary restricting groove 73 are slanted forward toward the mating side of the terminal fitting 30 with a mating terminal fitting. The lower surfaces of the auxiliary restrictable projection 72 and the auxiliary restricting groove 73 engage each other when the auxiliary restrictable projection 72 is fit into the auxiliary restricting groove 73. Accordingly, even if a force acts to open (twist) the front portion 37*a* of the outer wall 37 outward, the restrictable projection 70 and the restricting groove 71 are engaged at the rear side and the auxiliary restrictable projection 72 and the auxiliary restricting groove 73 are engaged at the front side. Therefore the outward opening twisting deformation of the front portion 37*a* of the outer wall 37 is prevented.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

In the foregoing embodiments, the front-portion holding piece is bent toward the front-portion holding groove to fit the auxiliary restrictable projection into the restricting groove after the front portion of the outer wall is bent with respect to the sidewall. However, the projecting length of the restrictable portion can be reduced, and the front portion of the outer wall may be bent with respect to the side wall to fit the auxiliary restrictable projection into the restricting groove after the front-portion holding piece is bent with respect to the front portion of the outer wall.

The restrictable projection is on the front-portion holding piece and the restricting groove is in the front-portion holding groove in the foregoing embodiments. However, a restrictable groove may be formed by partly cutting out the front-portion holding piece and a restricting projection that fits in the restrictable groove may be on the surface of the front-portion holding groove.

The front-portion holding piece and the front-portion holding groove have the restrictable projection and the restricting groove to restrict the opening deformation of the front portion of the outer wall in the foregoing embodiments. However, a rear-portion holding piece and a rear-portion holding groove may have a restrictable projection and a restricting groove to restrict the opening deformation of the rear portion of the outer wall.

The restrictable projection and the restricting groove at the rear ends of the front-portion holding piece and the front-portion holding groove may be deleted from the second embodiment.

Although the bottom wall is located inside the outer wall in the main body in the foregoing embodiment, the bottom wall may be deleted.

Although female terminal fittings are described and illustrated herein, the invention is also applicable to male terminal fittings.

Locks integrally formed in the female housing are shown as the fastening portions in the foregoing embodiments. However, a retainer formed separately from the female housing and configured to hold the female terminal fittings in the female housing also is embraced by the invention. Additionally, the locks may be supported at one or both ends according to the invention.

What is claimed is:

1. A terminal fitting comprising an elongate rectangular tubular main body having first through fourth walls, the first and fourth walls defining a corner of the elongate rectangular tubular main body, at least one holding groove formed in a portion of the first wall adjacent the fourth wall, the holding groove widening at locations farther from the fourth wall to define at least one restricting portion facing angularly away from the fourth wall, and at least one holding piece projecting from a portion of the fourth wall substantially adjacent the first wall, the holding piece widening at locations farther from the fourth wall for defining at least one restrictable portion facing angularly back toward the fourth wall, the holding piece being engaged in the holding groove so that the restrictable portion engages the restricting portion for preventing loose longitudinal movement of the walls and for restricting an opening deformation of the fourth wall away from the first wall.

2. The terminal fitting of claim 1, wherein the terminal fitting has opposite front and rear ends, the restrictable portion and the restricting portion being provided at portions of the holding piece and the holding groove facing the rear end.

3. The terminal fitting of claim 2, wherein the fourth wall has a locking projection for locking the terminal fitting by the engagement with a fastening portion provided in a connector housing when the terminal fitting is inserted into the connector housing.

4. The terminal fitting of claim 3, wherein the fourth wall has a cut-away portion for receiving the fastening portion, the fastening portion being engageable with a cut end surface of the cut-away portion, the fourth wall being divided into a front portion and a rear portion by the cut-away portion.

5. The terminal fitting of claim 4, wherein the holding piece and the restrictable portion extend from the front portion of the fourth wall.

6. The terminal fitting of the claim 2, wherein an auxiliary restrictable portion is provided on a side of the holding piece facing the front end of the terminal fitting, and an auxiliary restricting portion is provided in the holding groove, the auxiliary restricting portion engaging the auxiliary restrictable portion for restricting the opening deformation of the fourth wall.

7. The terminal fitting of claim 6, wherein the first wall is formed with at least one reinforcement bead.

8. A connector, comprising:

a connector housing with at least one cavity, and a fastening portion projecting into the cavity; and a terminal fitting inserted in the cavity, the terminal fitting having an elongate rectangular tubular main body having first through fourth walls, the first and fourth walls defining a corner of the elongate rectangular tubular main body, a cut-away portion being formed in the fourth wall and dividing the fourth wall into a front portion and rear portion, at least one holding groove formed in a portion of the first wall adjacent the front portion of the fourth wall, and at least one holding piece projecting from part of the front portion of the fourth wall substantially adjacent the first wall, the holding piece being engaged in the holding groove for preventing loose longitudinal movement of the first wall and the front portion of the fourth wall.

9. The connector of claim 8, wherein the housing has a fastener in the cavity, the fourth wall of the terminal fitting being engaged with the fastener.

10. A terminal fitting comprising an elongate rectangular tubular main body having first through fourth walls, the tubular main body further having opposite front and rear ends, the fourth wall being formed with a cut-away portion at a location spaced from both said front and rear ends of said rectangular tubular main body, such that said cut-away portion divides said fourth wall into a front portion and a rear portion, the cut-away portion being configured for receiving a fastening portion in a connector housing when the terminal fitting is inserted into the connector housing, such that the fastening portion is engageable with a cut end surface defined on the front portion of the fourth wall, the first and fourth walls defining a corner on the elongate rectangular tubular main body, at least one holding groove formed in a portion of the first wall adjacent the front portion of the fourth wall, and a holding piece projecting from the front portion of the fourth wall and engaged in the holding groove for preventing loose longitudinal movement of the walls at locations forward of the cut-away portion.

* * * * *